United States Patent [19]

Calderon

[11] 4,002,537

[45] Jan. 11, 1977

[54] POLLUTION CONTROL OF COKE OVENS

[76] Inventor: Albert Calderon, 1065 Melrose Drive, Bowling Green, Ohio 43402

[22] Filed: Sept. 30, 1974

[21] Appl. No.: 510,659

[52] U.S. Cl. ..... 202/248; 202/242; 202/269; 110/173 R; 49/475; 49/480; 49/485

[51] Int. Cl.[2] ..... C10B 25/16

[58] Field of Search ..... 202/248, 269, 242; 110/173 R; 49/480, 475, 485

[56] References Cited

UNITED STATES PATENTS

| | | | |
|---|---|---|---|
| 1,908,467 | 5/1933 | Wolff | 202/248 |
| 2,780,590 | 2/1957 | Doll | 202/248 |
| R20,515 | 9/1937 | Van Ackeren | 202/248 |

*Primary Examiner*—James H. Tayman, Jr.

[57] ABSTRACT

An improved method and apparatus for by-product coke oven operation wherein the problems of pollution caused by gases leaking out of the oven during the coking cycle are eliminated by providing an improved coke oven door using the metal-to-metal contact principle. Because of thermal conditions the distortion of the jambs and the distortion of the doors themselves takes place thus making the sealing of coke oven doors very difficult; this in particular is very serious with respect to high ovens. This distortion being of such form that the distortion of the jamb occurs in the opposite direction of the distortion of the oven door. This invention compensates for such distortion and makes possible the proper fit up of the door to a particular jamb irrespective of the degree of distortion.

11 Claims, 15 Drawing Figures

PRIOR ART

POLLUTION CONTROL OF COKE OVENS

The present invention relates to an improved method and apparatus for stopping the leakage of gases from by-product coke ovens of the type commonly used for the commercial production of coke.

In the art of making coke in a by-product oven which is one of many ovens situated side by side in battery form, the coal is charged in slot-type chambers and is heated indirectly by means of heated refractory walls. During the baking or the "coking" cycle which lasts about seventeen hours, the oven is under positive pressure which causes the gases evolved from the coal to be forced to leave the oven by means of an ascension pipe. These gases are processed in the by-product coke plant which is connected to the battery. The battery of ovens has two sides, the pusher side and the coke side and each oven has two doors, one on the pusher side and one on the coke side. Each of the said doors is secured to said oven by means of latches, one at the top and one at the bottom which latches are put in tension to press the door against the door jamb of the oven.

Because of thermal conditions the oven jambs, after the lapse of a period of time, tend to bulge and to bow away from the oven with the result that the bow may be as much as one and three-quarter inches of protrusion midway when compared to the top and bottom of the same jamb. The doors also being heated on the side facing the oven bulge midway as much as one and one-fourth inches when compared to the top and bottom of the door with the result that the direction of the bow of the door is opposite to the bow of the jamb. Such opposite distortion or bowing cause the upper and lower portions of the door and the jamb to have a relatively big gap which becomes very difficult to seal. The bowing of the jamb convex-like away from the oven and the bowing of the door convexlike towards the oven, poses a very serious pollution problem. These opposite distortions of jambs and doors contribute to fires which overheat the battery steel-work and cause the structural weakening of the whole battery, this being particularly true in the case of the high ovens such as the new six meter batteries currently being constructed.

The three types of coke oven doors generally used throughout the world are known as the Koppers, Wilputte and the Wolff. Reference is made to U.S. Steel publication "Making, Shaping & Treating of Steel", 1970 Edition, pages 122 and 123. These self-sealing doors are successful as long as the problem of bowing of jambs and doors is insignificant. The principle of sealing used by these parties are shown in one of the attached drawings. With the changing standards of the quality of air and the increased height of the ovens, the three types of doors currently used are failing to meet the new EPA standards, and also, the fires generated around the oven doors is of major concern to the coke manufacturing industry.

If the sealing surfaces of the door and the jamb are relatively parallel the sealing of the door to the jamb is simple by applying pressure against the sealing edge of the door and urging it to mate with the machined face of the jamb. However, it is difficult to seal with the bowing conditions prevailing in the industry.

Therefore, the main object of this invention is to provide a method and apparatus for properly sealing oven doors despite the distortion existing by providing a system incorporating a compliant structure in conjunction with a restraining feature in order to make possible the intimate mating of the door to the jamb frame to provide a positive metal-to-metal seal, not only in low ovens but also to take care of the high ovens which are now in vogue.

Another object of the present invention is to provide a flexible sealing means which in cooperation with a guide feature means results in linear movement, said means jointly being incorporated in existing door bodies in order to make the conversion possible and obviate the necessity of discarding the present bodies of the doors.

Further another object of the instant invention is the provision of an improved door possessing a simple and dependable means for sealing with means adjustment to take care of the greatest magnitude of distortion such as a three (3) inch gap between the door and the oven jamb.

Yet another object of this invention comprises a rugged construction to take the abuse to which coke oven doors are subjected during extraction and placement by including a flexible sealing means which is substantially stronger and protected.

Still another object of the instant invention is to eliminate the damaging fires which put stresses on the steelwork of the battery by having a seal between door and jamb which is dependable by virtue of having said seal free to move perpendicularly to the sealing surface of said jamb.

Further yet it is an object of this invention to provide a self-sealing coke oven door assembly comprising a door jamb to mate with a door which will greatly reduce smoke and require minimum maintenance by having means on said door that compensate for the distortion thereof.

Other objects of this invention will appear from the following detailed description and appended claims.

Reference is made to the accompanying drawings forming a part of this specification wherein like reference characters designate corresponding parts on the various views.

BRIEF DESCRIPTION OF DRAWINGS:

FIG. 4 shows the condition of the door after bowing.

Before explaining in detail the present invention it is to be understood that the invention is not limited to its application and to the details of construction and arrangement of the parts illustrated in the accompanying drawings since the invention is capable of other embodiments. Also it is to be understood that the phraseology or terminology herein is for the purpose of description and not limitation.

Figures 1, 2, 3, 4, 5, 6, 7, 8, 9:
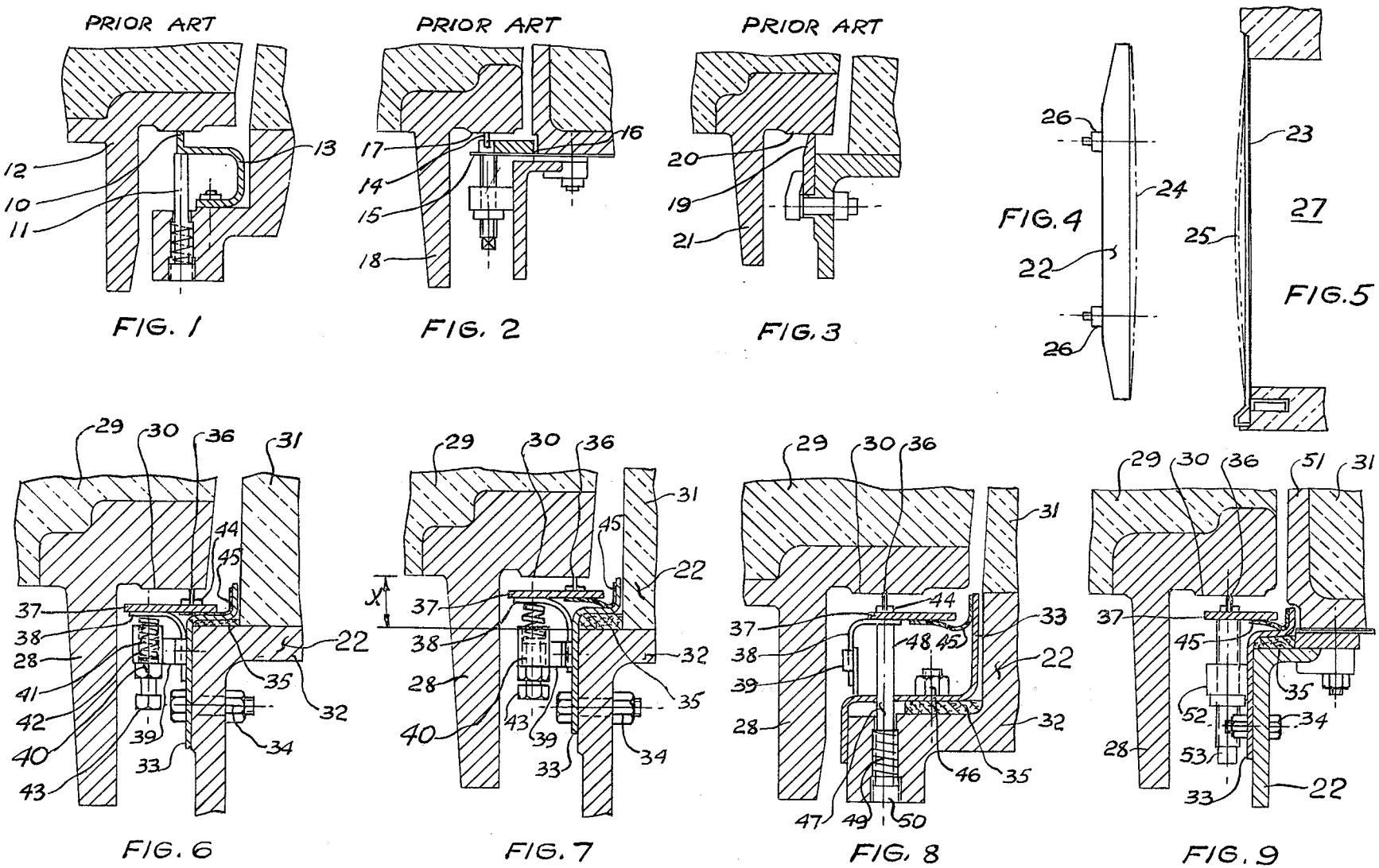
FIG. 1 PRIOR ART
FIG. 2 PRIOR ART
FIG. 1 is a partial sectional view showing the sealing arrangement per Koppers.
FIG. 2 is a partial sectional view of the arrangement employed by Wilputte.
FIG. 3 is a partial sectional view of the sealing arrangement used by Otto.
FIG. 4 is an outline of a coke oven door being shown before distortion; the dotted outline in this
FIG. 5 is the outline of a partial oven showing in solid the jamb before distortion and the dotted outline illustrates the contour of the jamb after the bowing takes place.
FIG. 6 is a partial section view of the sealing structure taken at 6—6 of FIG. 14, showing the condition of the instant invention as the sealing edge is in position at about midway of the door which position requires the least amount of compensation for distortion.
FIG. 7 is a partial sectional view of the instant invention taken at 7—7 of FIG. 15, showing the condition of the sealing edge at a substantial compensatory stage.
FIG. 8 shows by way of example the conversion of a Koppers-type door to the instant invention.
FIG. 9 is a partial sectional view showing the conversion of a Wilputte-type door to the structure of the instant invention.

DETAILED DESCRIPTION OF DRAWINGS:

FIGS. 1–3 refer to sealing means of the prior art. In FIG. 1, upon urging sealing means 10 by means of spring loaded stud 11, the gap between sealing edge 10 and jamb 12 is reduced except that edge 10 moves radially about point 13. In FIG. 2 sealing edge 14 mounted on diaphram 15 moves radially about point 16 of diaphram 15 to reduce the gap between sealing edge 14 and surface 17 of jamb 18. In FIG. 3, sealing edge 19 is moved linearly towards machined surface 20 of jamb 21 in order to form a seal.

In FIGS. 4 and 5, 22 indicates the door and 23 the oven jamb. Door 22 assumes the contour shown by phantom line 24 after distortion and jamb 23 assumes the outline shown by phantom lines 25 after distortion. Door 22 possesses latches 26 for locking the door on to oven 27.

Figure 14:
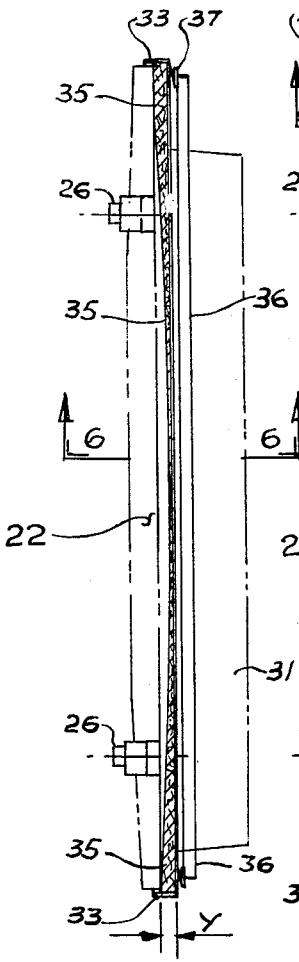
FIG. 14 is a side view of the door showing the compensation for distortion of the door with the sealing edge before mating with a distorted jamb.

FIG. 6 is a partial section taken about mid-point of door 22 along 6—6 of FIG. 14. In FIG. 6, 28 is the jamb mounted against brickwork 29 of the oven and it possesses sealing surface 30. Oven door 22 which is partially shown in FIG. 6 comprises brick plug 31 and main casting 32. For compensation of the distortion of door 22, cradle 33 is provided with a planar surface and by way of example, it is fastened to casting 32 by means of nut and bolt assembly 34. Packing 35 is provided between cradle 33 and casting 32 to prevent smoke for escaping under cradle 33. Sealing edge 36 is mounted on pressure plate 37 which is compliant for bowing movement, which plate in turn is constrained by a plurality of constraining means spaced at intervals, such as restrictor 38. Restrictor 38 is guided by means of strap 39 which is attached to cradle 33. Adjustment assembly 40 is preferably made up of spring 41, cage 42 and bolt and nut arrangement 43. Sealing edge 36 and pressure plate 37 easily flex along the vertical axis of the door. Sealing edge 36 is secured to pressure plate 37 by any of known methods or pinched in place by holder 44. A relatively thin and deformable membrane 45, preferably L-shaped, closes the gap between cradle 33 and pressure plate 37 for a gas tight arrangement. Membrane 45 is preferably fastened to cradle 33 and to the underneath side of pressure plate 37 by means of any known method such as welding.

Figure 15:
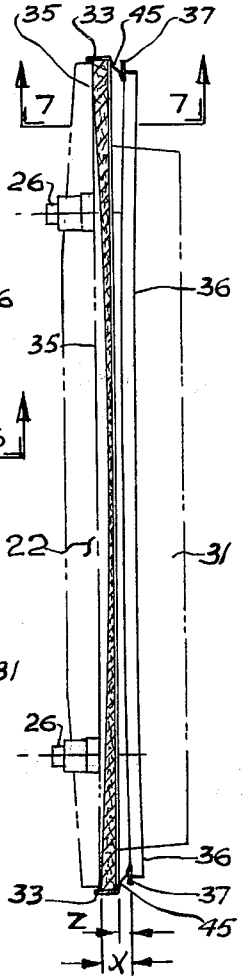
FIG. 15 is a side view of the door showing the sealing edge in the advanced position to conform to the distorted jamb.

FIG. 7 is the same as FIG. 6 except it is taken at 7—7 of FIG. 15. It is to be noted that sealing surface 30 of jamb 28 is receded by dimension X caused by distortion of door 22 and jamb 28. Dimension X is closed by moving pressure plate 37 by means of adjustment assembly 40 in order to keep sealing edge 36 in intimate contact with sealing surface 30 of jamb 28. Sealing edge 36 is urged to move perpendicularly to sealing surface 30 at any position along the jamb surface 30. Restrainer 38 which is attached to pressure plate 37 and which is guided within strap 39 guarantees the linear movement of pressure plate 37 which in turn moves sealing edge 36 perpendicular to jamb surface 30. The advancement of sealing edge 36 perpendicularly as described results in the linear motion thereof. The flexture of pressure plate 37 and sealing edge 36 attached thereto along the length of the door requires no substantial force for compliancy. Deformable membrane 45 assumes the shape of a reclined figure 7 instead of an L as shown in FIG. 6. It is also to be noted that the clearance between cradle 33 and casting 32 is greater. Packing 36 demonstrates that the distortion of door 22 at 7—7 must be compensated more than the distortion at 6—6. Bolt 43 in FIG. 7 has also been advanced from the position shown in FIG. 6. FIGS. 6 and 7, by way of example, show the invention as an improvement over the door construction shown by FIG. 3.

Referring to FIG. 8, cradle 33 is secured to casting 32 by means of nut and bolt 46 instead of nut and bolt assembly 34 because of a different adaptation. Sealing edge 36 is urged against surface 30 by means of adjustment 47 which is made up of stud 48, spring 49 and set-screw 50. This arrangement which makes possible for the linear compensation for distortion also possesses sealing edge 36 mounted on flexible pressure plate 37 constrained by restrictor 38 which in turn is guided in strap 39. The gap between pressure plate 37 and cradle 33 is also closed by deformable membrane 45.

In FIG. 9 the arrangement is as follows:- Door 22 possesses brick plug 31 contained in retainer 51 and cradle 33 may be mounted the same as the case in FIG. 6. Sealing edge 36 is mounted on pressure plate 37 which jointly are constrained to move linearly by being guided in guide 52. Adjustment means 53 urges plate 37 towards sealing surface 30 of jamb 28 thus forcing edge 36 to seal against surface 30. Membrane 45 which is also thin and formable complies easily from an L position to a reclined 7 position without creating component parallel forces to sealing edge 36.

Figure 11:
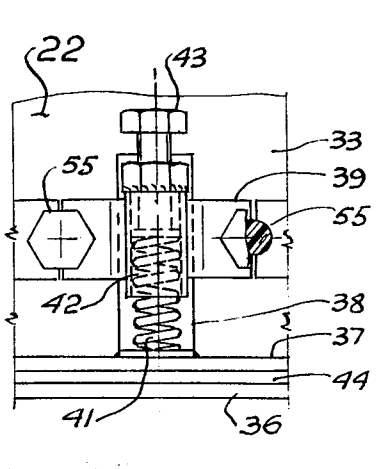
FIG. 11 is a partial side view of FIG. 10.
Figure 10:
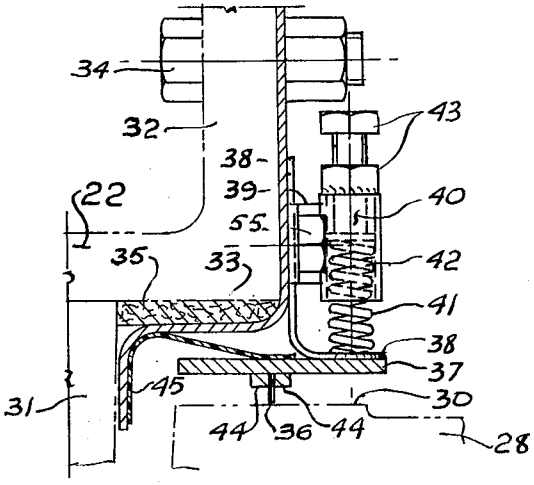
FIG. 10 is an enlarged partial sectional view of the invention.

Referring to FIGS. 10 and 11 the mounting of bracket 39 is an arrangement that may be used for making possible the removal of spring assembly 40 by having bolts 55 to secure brackets 39 to casting 32.

Figure 12:
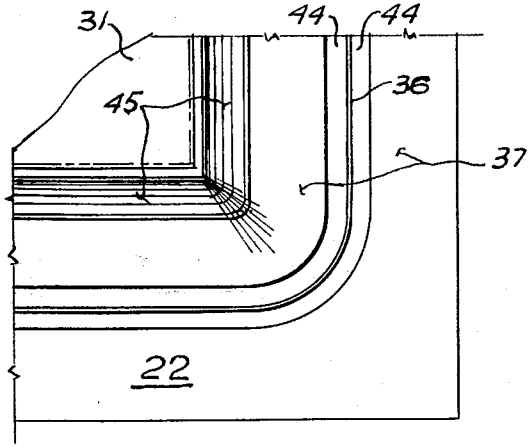
FIG. 12 is a partial top view looking at a corner of the pressure plate, sealing edge and membrane.

In FIG. 12 formable membrane 45 is shown in plan view by being deformed in two directions with its corner resisting deformation as this is inherent. For this reason it is important for making membrane 45 of very thin formable stock to overcome the bending forces resulting from moving pressure plate 37 around the corner and maintaining perpendicular component forces to sealing edge 36 not only on the sides but also at top and bottom of door 22.

Figure 13:
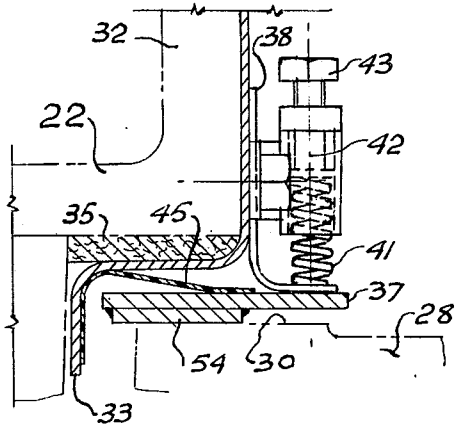
FIG. 13 is an alternate structure using a flat bar instead of an edge for sealing.

In FIG. 13 sealing edge 54 takes the shape of a flat bar attached to pressure plate 37 and adapted to move linearly and perpendicularly towards sealing surface 30 of jamb 28. The adjustment of pressure plate 37 is similar to the arrangements described. The desirability of sealing with a bar instead of an edge is to keep tar out of sealing surface 30 of jamb 28.

FIG. 14 shows the compensation for the distortion of door 22 represented by the letter Y, and FIG. 15 shows sealing edge 36 complying to conform to a distorted jamb by advancing adjustment bolts and deform membrane 45 so that pressure plate 37 moves towards the oven a space equal to letter Z. The total distortion of the door and the jamb being represented by the summation of Y and Z to equal X which is quite appreciable and measures about 3 inches. Door 22 is equipped with an adequate number of adjusting bolt arrangements 40 around the periphery of the door in order to exert pressure on pressure plate 37 at pre-determined points to move pressure plate 37 linearly with sealing edge 36 or sealing bar 54 against sealing surface 30 of jamb 28 and to intimately mate with surface 30.

While the operation of the method and apparatus of the present invention may be comprehended from a study of the foregoing description it is believed that the operation may be further explained as hereinafter set forth:

OPERATION

Referring to FIGS. 4 and 5, Door 22 by means of the door extracting machine commonly known in the art (not shown), places door 22 against the end of oven 27 and latches it in position. The adjustment bolts, similar to bolt 43, are tightened around the periphery of the door so that pressure plate 37 is urged towards surface 30 and thusly move sealing edge 36 to contact perpendicularly sealing surface 30. An attempt to introduce a feeler gauge between sealing edge 36 and sealing surface 30 determines whether or not sealing edge 36 is intimately in contact with sealing surface 30. Failure to succeed in the introduction of said feeler gauge is evidence that intimate contact between sealing edge 36 and sealing surface 30 does exist. The successful introduction of said feeler gauge dictates the further tightening of bolt 43 until the feeler gauge cannot be introduced between sealing edge 36 and sealing surface 30. Such adjustment follows the whole periphery of the door with the result that the complete sealing edge 36 is mating against the complete sealing surface 30 of jamb 28.

It is conceivable that in lower ovens where the distortion is not excessive the compensation for the distortion of the door is minimal and cradle 33 may be obviated or in cases where the door is straight, cradle 33 may also be obviated. It is also conceivable not to spring-load adjusting assemblies 40. All in all it is submitted by imparting flexture, to a sealing edge to conform to the distorted jambs and by securing a substantially planar surface such as a cradle, to distorted doors coupled with the linear movement of said sealing edge and perpendicularly against the sealing surface of the jamb, the present invention provides an improved method and apparatus for controlling emissions caused by leakage from coke oven doors. In the case of high ovens the problem of oven door leakage is most serious and this invention contemplates to solve this worrisome problem.

I claim:

1. Apparatus comprising a coke oven door having a seal assembly for sealing a space between a coke oven door and door jamb when the door is disposed in a position in which it substantially closes an opening in a coke oven, said seal assembly comprising a pressure plate connected to said door, and having a first surface facing toward the jamb and a second surface facing away from the jamb when the door is in the position in which it substantially closes the opening in the oven, said pressure plate further including inner and outer surfaces joining the first and second surfaces, first seal means connected with said first surface of said pressure plate for sealingly engaging a surface of the door jamb which faces the first surfaces of the pressure plate, positioning means for moving said pressure plate in a path extending perpendicular to the first and second surfaces of the pressure plate to press said first seal means into sealing engagement with the door jamb, said positioning means being effective to move said pressure plate along said path between a retracted position in which the pressure plate is closely adjacent to a portion of the door and an extended position in which the pressure plate is spaced from the portion of the door while maintaining said first and second surfaces of said pressure plate perpendicular to the path of movement of said pressure plate.

2. Apparatus as defined in claim 1 wherein said inner surface faces generally towared a central portion of the door and said outer surface faces away from the central portion of the door, further including second seal means extending between the door and a portion of the pressure plate adjacent to said inner surface for sealing a space between the door and said pressure plate, said second seal means being ineffective to deflect said pressure plate relative to the surface of the door jamb engaged by said first seal means upon movement of said pressure plate between the extended and retracted positions.

3. Apparatus as defined in claim 1 further including second seal means between said pressure plate and the door for sealing a space between the door and the pressure plate, said second sealing means being ineffective to deflect said pressure plate relative to the surface of the door jamb engaged by said first seal means upon movement of said pressure plate between the extended and retracted positions.

4. Apparatus as defined in claim 3 wherein said second seal means includes a first portion fixedly connected with said second surface of said pressure plate and a second portion fixedly connected with the door.

5. Apparatus as setforth by claim 4 wherein said second seal means further comprises a formably member which is compliantly movable with said pressure plate while being ineffective to deflect said pressure plate relative to said path upon movement of said pressure plate between the extended and retracted positions.

6. Apparatus as setforth by claim 5 wherein said positioning means comprises a force applying means for applying a force to said second surface of said pressure plate at a location disposed outwardly of a point located midway between said inner and outer surfaces, said positioning means further including means for resisting deflection of said pressure plate relative to said path comprising means engaging said second surface at a location disposed outwardly of said location which is midway between said inner surface and said outer surface.

7. A seal assembly for sealing a space between a coke oven door and door jamb when the door is disposed in a position in which it substantially closes an opening in a coke oven, said seal assembly comprising a pressure plate connected to said door and having a first surface facing toward the jamb and a second surface facing away from the door jamb when the door is disposed in the position in which it substantially closes the opening in the oven, said pressure plate further including inner and outer surfaces joining the first and second surfaces, first seal means connected with said first surface of said pressure plate for sealingly engaging the surface of the door jamb, a second seal means extending between the door and a portion of the pressure plate adjacent to said inner surface for sealing a space between the door and said pressure plate for blocking fluid flow through a space between the first and second portions of said second seal means, said second seal means comprising a formable member having a first portion fixedly connected with said pressure plate and a second portion fixedly connected with the door, positioning means connected with said second surface of said pressure plate for moving said pressure plate along a path extending perpendicular to the first and second surfaces of the pressure plate to press said first seal means into sealing engagement with the door jamb, said positioning means being effective to move said pressure plate along said path between a retracted position in which the pressure plate is closely adjacent to a portion of the door and an extended position in which the pressure plate is spaced from the portion of the door while maintaining said first and second surfaces of said pressure plate perpendicular to the path of movement of said pressure plate upon movement of said pressure plate between the extended and retracted positions, said formable member being compliantly movable with said pressure plate and being ineffective to deflect said pressure plate relative to said path upon movement of said pressure plate between the extended and retracted positions.

8. An assembly as defined in claim 7 wherein said formable member comprises a substantially L-shaped member having first and second legs, means joining first end portions of said first and second legs to each other, means joining a second end portion of said first leg with said second surface of said pressure plate, and means joining the second end portion of said second leg with said door.

9. An assembly as setforth in claim 7 including force applying means for applying a force to said second surface of said pressure plate and in a direction perpendicular to said second surface for urging said pressure plate from said retracted position to said extended position, said force applying means being disposed outwardly of a location located midway between said inner and outer surfaces.

10. An assembly as setforth by claim 9 including means for resisting deflection of said pressure plate relative to said path upon application of said force applying means to said pressure plate.

11. An assembly as set forth by claim 10 wherein said pressure plate comprises first and second side portions and top and bottom end portions joined to said first and second side portions to form a continuous pressure plate member, said first seal means comprising a sealing member connected to said first surface of said continuous pressure plate member and extending continuously around said continuous pressure plate member, said second seal means comprising a continuous formable member extending continuously about said continuous pressure plate member, and a plurality of force applying means disposed at predetermined spaced locations about said continuous pressure plate member.

* * * * *